US008757752B2

(12) United States Patent
Yokomaku

(10) Patent No.: US 8,757,752 B2
(45) Date of Patent: Jun. 24, 2014

(54) METHOD OF CONTROLLING LIQUID EJECTION HEAD, AND LIQUID EJECTION DEVICE

(75) Inventor: Hiroomi Yokomaku, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 57 days.

(21) Appl. No.: 13/489,743

(22) Filed: Jun. 6, 2012

(65) Prior Publication Data

US 2012/0320118 A1 Dec. 20, 2012

(30) Foreign Application Priority Data

Jun. 17, 2011 (JP) ..... 2011-135142

(51) Int. Cl.
*B41J 29/38* (2006.01)
*B41J 2/045* (2006.01)

(52) U.S. Cl.
CPC ..... *B41J 2/04581* (2013.01); *B41J 2/04588* (2013.01); *B41J 2/04595* (2013.01); *B41J 2/04573* (2013.01)
USPC ..... 347/11; 347/68

(58) Field of Classification Search
CPC ..... B41J 2/04541; B41J 2/04588; B41J 2/04591; B41J 2/04593; B41J 2/04595
USPC ..... 347/9–11, 68
See application file for complete search history.

(56) References Cited

U.S. PATENT DOCUMENTS 8,025,353 B2 * 9/2011 Hasenbein ..... 347/11

FOREIGN PATENT DOCUMENTS

| | | | |
|---|---|---|---|
| JP | 07-290720 | A | 11/1995 |
| JP | 2004-034471 | A | 2/2004 |
| JP | 2010-094871 | A | 4/2010 |

* cited by examiner

*Primary Examiner* — An Do
(74) *Attorney, Agent, or Firm* — Harness, Dickey & Pierce, P.L.C.

(57) ABSTRACT

A method of controlling a liquid ejection head controls a liquid ejection head including a liquid pressurizing chamber, nozzles communicating with the liquid pressurizing chamber, and a pressure generating device that generates pressure in the liquid pressurizing chamber based on a drive waveform. The method includes generating a preliminary ejection drive waveform with a predetermined number of successive drive pulses aligned in descending order of length of drive pulse intervals of the drive pulses, with each of the drive pulse intervals set to an integral multiple of a natural vibration period of the liquid pressurizing chamber, and applying the generated preliminary ejection drive waveform to the pressure generating device to cause the liquid ejection head to perform a preliminary ejecting operation.

9 Claims, 7 Drawing Sheets

METHOD OF CONTROLLING LIQUID EJECTION HEAD, AND LIQUID EJECTION DEVICE

CROSS-REFERENCE TO RELATED APPLICATION

This patent application is based on and claims priority pursuant to 35 U.S.C. §119 to Japanese Patent Application No. 2011-135142, filed on Jun. 17, 2011, in the Japan Patent Office, the entire disclosure of which is hereby incorporated by reference herein.

FIELD OF THE INVENTION

The present invention relates to a method of controlling a liquid ejection head, and a liquid ejection device.

BACKGROUND OF THE INVENTION

As a commonly used image forming apparatus, such as a printer, a facsimile machine, a copier, a plotter, and a multi-function machine combining the functions of two or more of these apparatuses, there is an image forming apparatus which uses a liquid ejection device including a recording head corresponding to a liquid ejection head that ejects droplets of a liquid, such as a recording liquid, for example, and which forms an image by causing the liquid to adhere to a recording medium conveyed past the recording head.

The liquid ejection device including the liquid ejection head includes a serial-type liquid ejection device and a line-type liquid ejection device. The serial-type liquid ejection device performs recording by mounting the liquid ejection head on a carriage and moving the carriage in a main scanning direction perpendicular to a recording sheet feeding direction. The line-type liquid ejection device uses a line-type head in which a plurality of nozzles serving as ejection ports for ejecting liquid droplets are disposed in rows over substantially the entire width of the sheet.

Further, the liquid ejection head is roughly divided into a few types of systems, depending on the type of actuator used for ejecting liquid droplets, such as ink droplets. For example, a piezo system and a bubble jet (registered trademark) system are commonly known. According to the piezo system, one wall of a liquid pressurizing chamber is formed of a relatively thin diaphragm, and a piezoelectric element serving as an electromechanical transducer element is provided for the diaphragm. Application of an electric current causes the piezoelectric element to deform, thereby deforming the diaphragm, changing the pressure in the liquid pressurizing chamber, and ejecting the ink droplets. According to the bubble jet system, a heating element is disposed in a liquid chamber and applied with current to generate bubbles by heating. With the pressure of the bubbles, the ink droplets are ejected.

According to another system using electrostatic force, a diaphragm forming one wall of the liquid chamber and individual electrodes disposed outside the liquid chamber facing the diaphragm are provided, and an electric field is applied between the diaphragm and the electrodes to generate an electrostatic force that deforms the diaphragm, thus changing the pressure and volume in the liquid chamber and ejecting the ink droplets from the nozzles. Hereinafter, devices which generate pressure in the above-described liquid pressurizing chamber or liquid chamber will be collectively referred to as the "device which generates pressure in a liquid pressurizing chamber based on a drive waveform."

The liquid ejection head ejects liquid droplets from the ejection ports to perform recording. Thus, if the liquid droplets are not ejected for a relatively long time, a solvent of the ink remaining in the ejection ports evaporates and viscosity of the ink is increased. Consequently, the ejection state may become unstable and cause a failure to eject the liquid droplets properly, with a concomitant deterioration in print quality. To prevent such a situation, therefore, a preliminary ejecting operation is performed that discharges the high-viscosity ink by ejecting from the nozzles liquid droplets that do not contribute to the image formation.

The liquid ejection device performing the preliminary ejecting operation includes, for example, a liquid ejection device in which, in successive liquid ejections based on a plurality of drive pulses, the high-viscosity ink is discharged with the liquid ejection speed set at maximum in the first preliminary ejection droplet and thereafter sequentially and gradually reduced to cause preliminary ejection droplets to fly without merging with one another. The liquid ejection speed is further reduced in the last preliminary ejection droplet to minimize the generation of a minute satellite liquid droplet and thereby reduce ink mist. Other known configurations includes devices in which the drive frequency of the liquid ejection head is increased in accordance with the reduction in viscosity of the ink, to thereby reduce the viscosity of the ink in the liquid ejection head to a normal value, or devices in which, to remove the high-viscosity ink, the drive waveform for the preliminary ejecting operation is varied between a preceding preliminary ejecting operation and a subsequent preliminary ejecting operation.

The drive pulse applied to the liquid ejection head in the preliminary ejecting operation is higher than the drive pulse applied to the liquid ejection head in normal image formation. This is because it is naturally desired to apply a relatively high drive pulse to the liquid ejection head to eject the high-viscosity ink. If a relatively high drive pulse is applied to the liquid ejection head from the beginning, however, an excessive load may be placed on meniscus, depending on the viscosity of the ink, and may cause a phenomenon such as nozzle-down (i.e., failure to eject the liquid droplets from the nozzles) and liquid stagnation. Yet none of the conventional configuration described above takes the problem of the load on the meniscus into account or provides a satisfactory solution thereto.

In terms of load on the meniscus, a background liquid ejection device that is disclosed in JP-2010-094871-A is intended to perform the operation of setting the liquid ejection speed to the highest value in the first one of the plurality of drive pulses and thereafter sequentially reducing the liquid ejection speed, i.e., intended to reduce the mist. As is obvious therefrom, this background liquid ejection device is not intended to reduce the excessive load on the meniscus due to the preliminary ejecting operation.

Another background liquid ejection device disclosed in JP-07-290720-A performs the preliminary ejection (alternatively referred to as preparatory ejection) while changing the drive frequency of the liquid ejection head. This background liquid ejection device is intended to efficiently perform the preparatory ejection of the viscosity-increased liquid in a relatively short time by performing the preparatory ejection while increasing the value of the drive frequency of the liquid ejection head. Therefore, the background liquid ejection device disclosed in JP-07-290720-A is neither intended to reduce the excessive load on the meniscus. Even if the control method of this background liquid ejection device is employed to reduce the excessive load on the meniscus, it is complicated and difficult to perform the control while changing the drive frequency.

Yet another background liquid ejection device disclosed in JP-2004-034471-A changes the drive waveform between before and after a group of preliminary ejections. In this case, the time interval of each group of preliminary ejections is of millisecond order. Thus, it is hardly considered that the high-viscosity ink is effectively removed. Further, this background liquid ejection device is not intended to reduce the excessive load on the meniscus.

SUMMARY OF THE INVENTION

The present invention provides a novel method of controlling a liquid ejection head. In one embodiment, a novel method of controlling a liquid ejection head controls a liquid ejection head including a liquid pressurizing chamber, nozzles communicating with the liquid pressurizing chamber, and a pressure generating device that generates pressure in the liquid pressurizing chamber based on a drive waveform. The method includes: generating a preliminary ejection drive waveform with a predetermined number of successive drive pulses aligned in descending order of length of drive pulse intervals of the drive pulses, with each of the drive pulse intervals set to an integral multiple of a natural vibration period of the liquid pressurizing chamber; and applying the generated preliminary ejection drive waveform to the pressure generating device to cause the liquid ejection head to perform a preliminary ejecting operation.

The present invention further provides another novel method of controlling a liquid ejection head. In one embodiment, another novel method of controlling a liquid ejection head controls a liquid ejection head including a liquid pressurizing chamber, nozzles communicating with the liquid pressurizing chamber, and a pressure generating device that generates pressure in the liquid pressurizing chamber based on a drive waveform. The method includes generating a preliminary ejection drive waveform for a first high-viscosity ink droplet ejection group with a predetermined number of successive drive pulses aligned in descending order of length of drive pulse intervals of the drive pulses, with each of the drive pulse intervals set to an integral multiple of a natural vibration period of the liquid pressurizing chamber, generating a preliminary ejection drive waveform for a high-viscosity ink droplet ejection group subsequent to the first high-viscosity ink droplet ejection group with drive pulses having the same drive pulse interval set to the natural vibration period of the liquid pressurizing chamber, and applying the generated preliminary ejection drive waveforms to the pressure generating device to cause the liquid ejection head to intermittently perform a preliminary ejecting operation with the high-viscosity ink droplet ejection groups, each with an arbitrary number of ejection droplets.

The present invention further provides a novel liquid ejection device. In one embodiment, a novel liquid ejection device includes a liquid ejection head, a waveform generating device, and a waveform applying device. The liquid ejection head is configured to include a liquid pressurizing chamber, nozzles communicating with the liquid pressurizing chamber, and a pressure generating device that generates pressure in the liquid pressurizing chamber based on a drive waveform. The waveform generating device is configured to generate a preliminary ejection drive waveform with a predetermined number of successive drive pulses aligned in descending order of length of drive pulse intervals of the drive pulses, with each of the drive pulse intervals set to an integral multiple of a natural vibration period of the liquid pressurizing chamber. The waveform applying device is configured to apply the generated preliminary ejection drive waveform to the pressure generating device to cause the liquid ejection head to perform a preliminary ejecting operation.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF THE INVENTION

Figure 1:
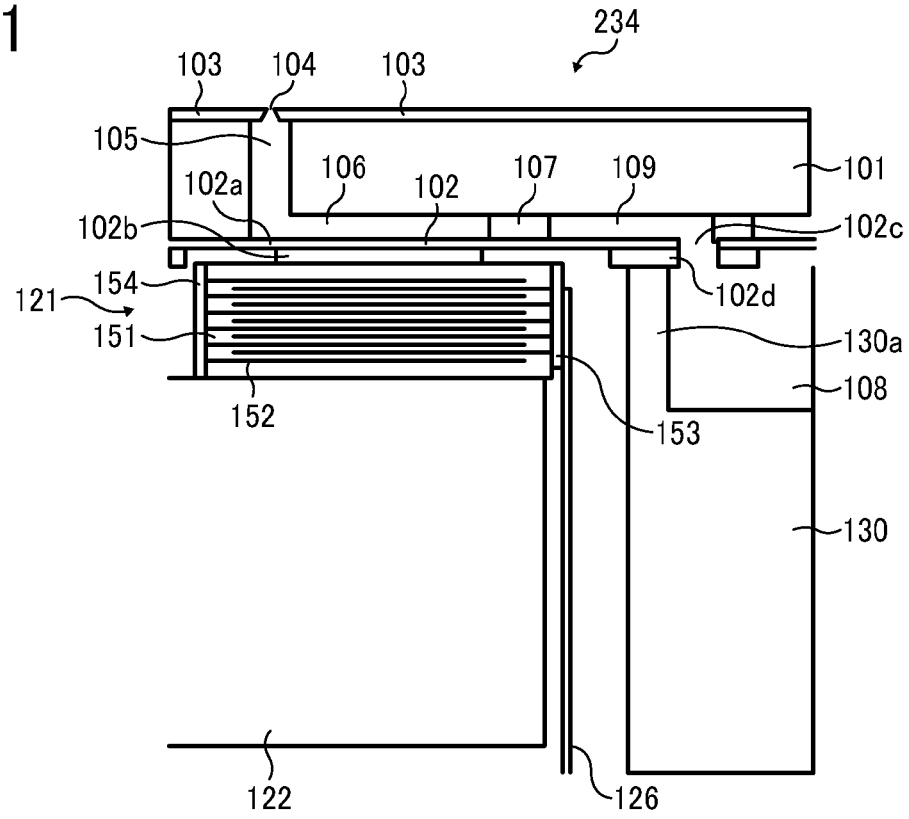
FIG. 1 is a cross-sectional view of a liquid ejection head for performing a method of controlling a liquid ejection head according to an embodiment of the present invention, along a long-side direction of liquid pressurizing chambers.

In describing the embodiments illustrated in the drawings, specific terminology is adopted for the purpose of clarity. However, the disclosure of the present invention is not intended to be limited to the specific terminology so used, and it is to be understood that substitutions for each specific element can include any technical equivalents that operate in a similar manner.

In the following description, the term "medium" is occasionally referred to as "sheet." The material of the medium is not limited, and the medium includes a recorded medium, a recording medium, a transfer material, and a recording sheet. Further, the term "recording liquid" is occasionally referred to as "ink" or "liquid," but is not limited to the ink. The recording liquid is not particularly limited, as long as the recording liquid is fluid when ejected. The term "image forming apparatus" refers to an apparatus which forms an image on a medium, such as paper, thread, fiber, fabric, leather, metal, plastic, glass, wood, and ceramic. The term "image formation" is used as a synonym of recording, printing, image printing, and character printing, and refers not only to providing a sheet with a meaningful image, such as a character and a figure, but also to providing a sheet with a meaningless image, such as a pattern. Further, the term "liquid ejection device" refers to an image forming apparatus that ejects a liquid from a liquid ejection head.

Figure 2:
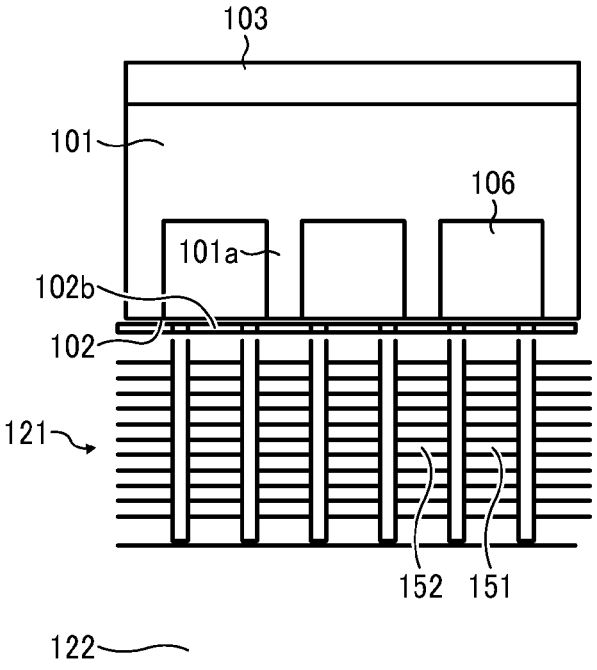
FIG. 2 is a cross-sectional view of the liquid ejection head illustrated in FIG. 1, along a short-side direction of the liquid pressurizing chambers.

Referring now to the drawings, wherein like reference numerals designate identical or corresponding parts throughout the several views, embodiments of the present invention will be described. With reference to FIGS. 1 and 2, description is given of a basic configuration of a liquid ejection head 234 for performing a method of controlling the liquid ejection head 234 according to an embodiment of the present invention. FIG. 1 is a cross-sectional view of the liquid ejection head 234, along a long-side direction of liquid pressurizing chambers 106. FIG. 2 is a cross-sectional view of the liquid ejection head 234, along a short-side direction of the liquid pressurizing chambers 106.

The liquid ejection head 234 used for performing the method of controlling the liquid ejection head 234 according to the embodiment of the present invention (hereinafter simply referred to as the liquid ejection head 234) includes a frame 130, a flow channel plate 101, a nozzle plate 103, a diaphragm 102, laminated piezoelectric elements (hereinafter simply referred to as the piezoelectric elements) 121, and a base plate 122. The frame 130 forms recesses serving as not-illustrated ink supply ports and common liquid chambers 108. The flow channel plate 101 forms recesses serving as fluid resistance portions 107 and the liquid pressurizing chambers 106, and also forms communication ports 105 communicating with nozzles 104. The nozzle plate 103 forms the nozzles 104. The diaphragm 102 includes diaphragm portions 102*a*, insular projecting portions (alternatively referred to as island portions) 102*b*, ink flow ports 102*c*, and thick film portions 102*d*. The piezoelectric elements 121 serve as mechano-electrical transducer elements joined to the diaphragm 102 via a bonding layer. The base plate 122 fixes the piezoelectric elements 121.

The base plate 122 is made of a barium titanate-based ceramic, and joins two rows of the piezoelectric elements 121. The piezoelectric elements 121 are divided into comb teeth-like portions by half-cut dicing, and the comb teeth-like portions are alternately used as drive and non-drive (i.e., support) portions. Each of the piezoelectric elements 121 includes alternately laminated piezoelectric layers 151 and internal electrode layers 152. Each of the piezoelectric layers 151 has a thickness of approximately 10 μm to 50 μm, and is made of lead zirconate titanate (PZT). Each of the internal electrode layers 152 has a thickness of a few micrometers, and is made of silver-palladium (AgPd). The internal electrode layers 152 are alternately electrically connected to individual electrodes 153 and a common electrode 154, which are external electrodes, i.e., end-face electrodes disposed on end faces.

The liquid ejection head 234 used in the present embodiment is configured to use the piezoelectric elements 121 in a d33 mode corresponding to displacement in the thickness direction, and contracts and expands the liquid pressurizing chambers 106 in accordance with the expansion and contraction of the piezoelectric elements 121. The liquid ejection head 234 may also be configured to apply pressure to the liquid pressurizing chambers 106 by using displacement in a d31 direction as the piezoelectric direction of the piezoelectric elements 121. Further, the liquid ejection head 234 may be structured to include one row of piezoelectric elements 121 provided on one base plate 122. The piezoelectric elements 121 expand in a direction when applied with a drive signal and charged, and contract in the opposite direction when the electric charge charged therein is discharged. The individual electrodes 153 of the drive portions have a flexible printed circuit (FPC) board 126 solder-joined thereto. Further, the common electrode 154 is joined to a ground (GND) electrode of the FPC board 126 via an electrode layer provided to an end portion of the piezoelectric element 121. A not-illustrated driver integrated circuit (IC) is mounted on the FPC board 126 to control the application of a drive voltage to the piezoelectric element 121.

In the diaphragm 102, the thin-film diaphragm portions 102*a*, the insular projecting portions 102*b* formed in respective central portions of the diaphragm portions 102*a* and joined to the drive portions of the piezoelectric elements 121, the thick film portions 102*d* including beams joined to support portions 130*a*, and openings serving as the ink flow ports 102*c* are formed by two superimposed layers of Ni-plated films produced by an electroforming method.

In the flow channel plate 101, recesses serving as the fluid resistance portions 107, the liquid pressurizing chambers 106, and liquid introduction portions 109 and through-holes serving as the communication ports 105 located at respective positions corresponding to the nozzles 104 are formed by a silicon single crystal substrate subjected to patterning according to an etching method. The remaining portions left by the etching form dividing walls 101*a* of the liquid pressurizing chambers 106.

The nozzle plate 103 is formed by a metal material, such as a Ni-plated film produced by an electroforming method, for example, and is formed with the multitude of nozzles 104 serving as minute ejection ports for ejecting ink droplets to fly. The shape of the interior, i.e., the internal shape of each of the nozzles 104 is horn-like, as illustrated in FIG. 1, and may be substantially cylindrical or conical.

An ink ejection surface of the nozzle plate 103 corresponding to a nozzle surface of the liquid ejection head 234 is provided with a not-illustrated layer of a water-repellent film subjected to water-repellent surface treatment. The water-repellent film is selected in accordance with physical properties of the ink to stabilize the shape and the flying performance of the ink droplets and obtain high image quality. The water-repellent treatment includes, for example, polytetrafluoroethylene (PTFE)-Ni eutectoid plating, electro-deposition coating of a fluorine resin, vapor deposition coating of an evaporable fluorine resin, such as fluorinated pitch, for example, and application and baking of a solvent of a silicon-based resin and a fluorine-based resin. The frame 130 forming the recesses serving as the ink supply ports and the common liquid chambers 108 is formed by resin molding.

In the thus configured liquid ejection head 234, a drive waveform corresponding to a drive pulse voltage ranging from approximately 10 V to approximately 50 V is applied to the piezoelectric elements 121 in accordance with a record signal. Thereby, displacement in the lamination direction occurs in the piezoelectric elements 121, and pressure is applied to the liquid pressurizing chambers 106 via the diaphragm 102. As a result, the pressure in the liquid pressurizing chambers 106 is increased, and the ink droplets are ejected from the nozzles 104.

Thereafter, the ejection of the ink droplets completes, and the ink pressure in the liquid pressurizing chambers 106 is reduced. Then, with the inertia of the ink flow and the discharge process of drive pulses, negative pressure is generated in the liquid pressurizing chambers 106, and the process shifts to an ink filling step. In this step, ink supplied from a not-illustrated ink tank flows into the common liquid chambers 108, sequentially passes the common liquid chambers 108, the ink flow ports 102*c* of the diaphragm 102, the liquid introduction portions 109, and the fluid resistance portions 107, and fills the liquid pressurizing chambers 106.

The fluid resistance portions 107 are effective in attenuating residual pressure vibration after the ejection, but act as resistance against refilling of the ink based on surface tension. If the fluid resistance portions 107 are appropriately selected, the balance between the attenuation of residual pressure and the refilling time is maintained, and a drive period corresponding to the time of transition to the next ink droplet ejecting operation is reduced.

A schematic configuration of a control unit 500 of a liquid ejection device 100 according to an embodiment of the present invention will now be described with reference to FIG. 3. The following description will be given of an example in which the liquid ejection device 100 is configured as a printer.

Figure 3:
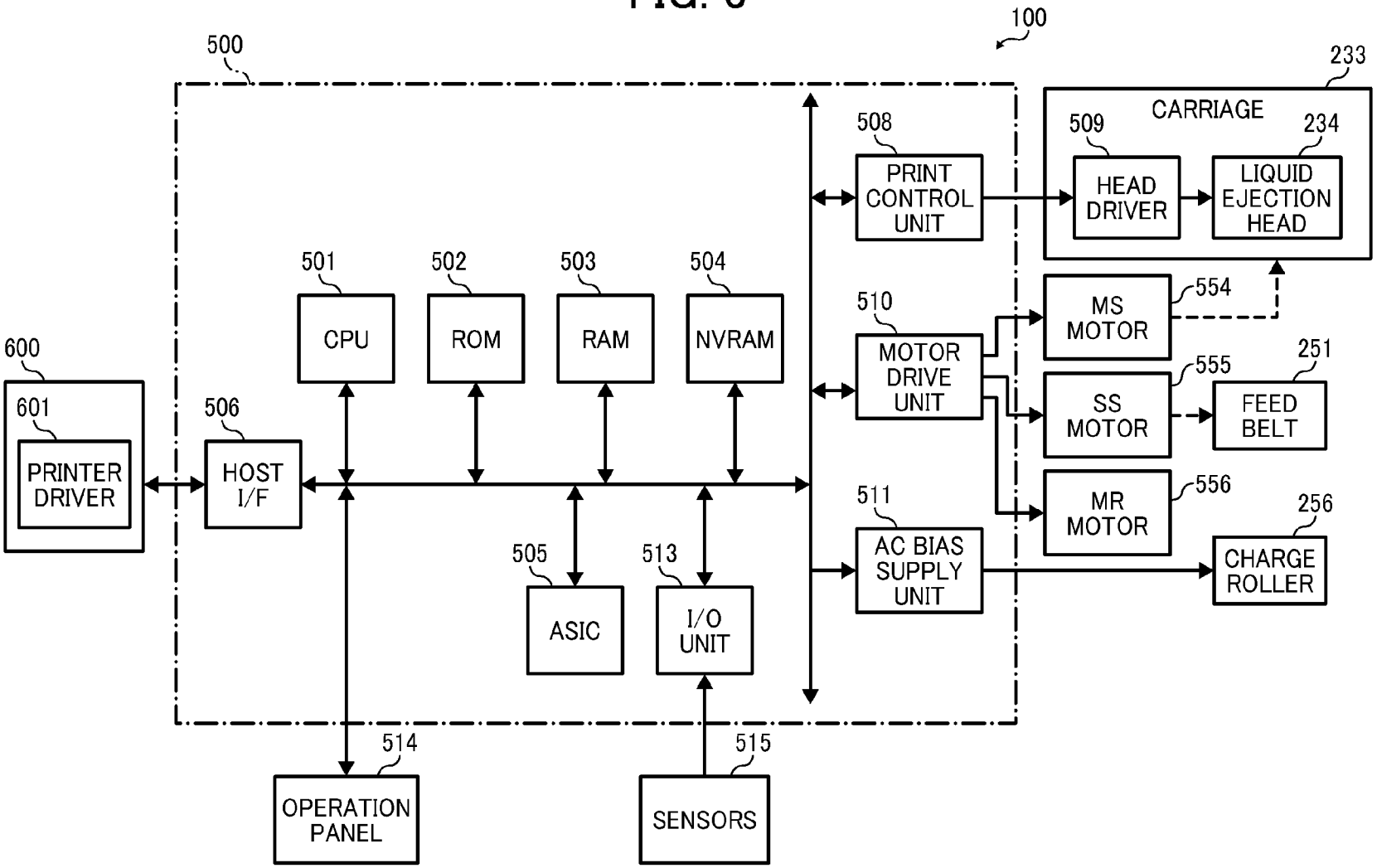
FIG. 3 is a block diagram illustrating a schematic configuration of a control unit of a liquid ejection device according to an embodiment of the present invention.

FIG. 3 is a block diagram illustrating the schematic configuration of the control unit 500. The control unit 500 includes a central processing unit (CPU) 501, a read-only memory (ROM) 502, a random access memory (RAM) 503, a rewritable nonvolatile RAM (NVRAM) 504, and an application-specific integrated circuit (ASIC) 505. The CPU 501 performs an overall control of the present liquid ejection device 100, and controls the preliminary ejecting operation of the liquid ejection device 100. The ROM 502 stores programs executed by the CPU 501 and other fixed data. The RAM 503 temporarily stores image data and so forth. The NVRAM 504 serves as a nonvolatile memory for retaining data even when the power supply of the liquid ejection device 100 is off. The ASIC 505 performs image processing, such as a variety of signal processing and rearrangement of image data, and processing of input and output signals for controlling the entire liquid ejection device 100.

The control unit 500 further includes a print control unit 508, a motor drive unit 510, an alternating-current (AC) bias supply unit 511, a host interface (I/F) 506, and an input-output (I/O) unit 513. The print control unit 508 includes a data transfer unit 702 and a drive waveform generation unit 701 illustrated in FIG. 4 for controlling the driving of the liquid ejection head 234, and controls a head driver 509 serving as a driver IC for driving the liquid ejection head 234 provided to a carriage 233. The motor drive unit 510 drives a main scanning (MS) motor 554 for moving the carriage 233 for scanning, a sub-scanning (SS) motor 555 for rotating a feed belt 251, and a maintaining and restoring (MR) motor 556 for driving a maintaining and restoring mechanism 281 illustrated in FIG. 10. The AC bias supply unit 511 supplies an AC bias to a charge roller 256. Further, the control unit 500 is connected to an operation panel 514 for inputting and displaying information necessary for the liquid ejection device 100.

The host I/F 506 transmits and receives data and signals to and from a host device 600. The host I/F 506 receives, through a cable or a network, an output signal from the host device 600, which includes an information processing device such as a personal computer, an image reading device such as an image scanner, and an imaging device such as a digital camera. The CPU 501 of the control unit 500 reads and analyzes print data from a receive buffer included in the host I/F 506, causes the ASIC 505 to perform necessary image processing, data rearrangement processing, and so forth, and causes the print control unit 508 to transfer the image data to the head driver 509. The generation of dot pattern data for outputting an image is performed by a printer driver 601 of the host device 600.

The print control unit 508 transfers the above-described image data in the form of serial data, and outputs to the head driver 509 a transfer clock, a latch signal, a control signal, and so forth necessary for the transfer of the image data and the confirmation of the transfer. The print control unit 508 performing the above-described operations includes the drive waveform generation unit 701 illustrated in FIG. 4, which is configured to include a digital-to-analog (D/A) converter for D/A-converting pattern data of drive pulses stored in the ROM 502, a voltage amplifier, and a current amplifier. With this configuration, the print control unit 508 outputs to the head driver 509 a drive signal including a drive pulse or a plurality of drive pulses.

The head driver 509 drives the liquid ejection head 234 based on the image data serially input by the print control unit 508, which corresponds to a line of data to be recorded by the liquid ejection head 234. That is, the drive pulse forming the drive signal supplied by the print control unit 508 is selectively applied by the head driver 509 to the piezoelectric elements 121 serving as drive elements that generate energy for ejecting liquid droplets of the liquid ejection head 234. Thereby, the liquid ejection head 234 is driven. The head driver 509 selects the drive pulse forming the drive signal, and thereby allows the liquid ejection head 234 to eject liquid droplets forming different sizes of dots, such as large-sized droplets, medium-sized droplets, and small-sized droplets, for example.

The I/O unit 513 acquires information from various kinds of sensors 515 installed in the liquid ejection device 100, extracts information necessary for the control of the printer, and performs processing contributing to the control of the print control unit 508, the motor drive unit 510, and the AC bias supply unit 511. The sensors 515 include, for example, an optical sensor for detecting the position of a sheet, a thermistor for monitoring the temperature in the liquid ejection device 100, a sensor for monitoring the voltage of a charging belt, and an interlock switch for detecting the opening and closing of a cover. The I/O unit 513 performs the above-described processes on a variety of sensor information.

Figure 4:
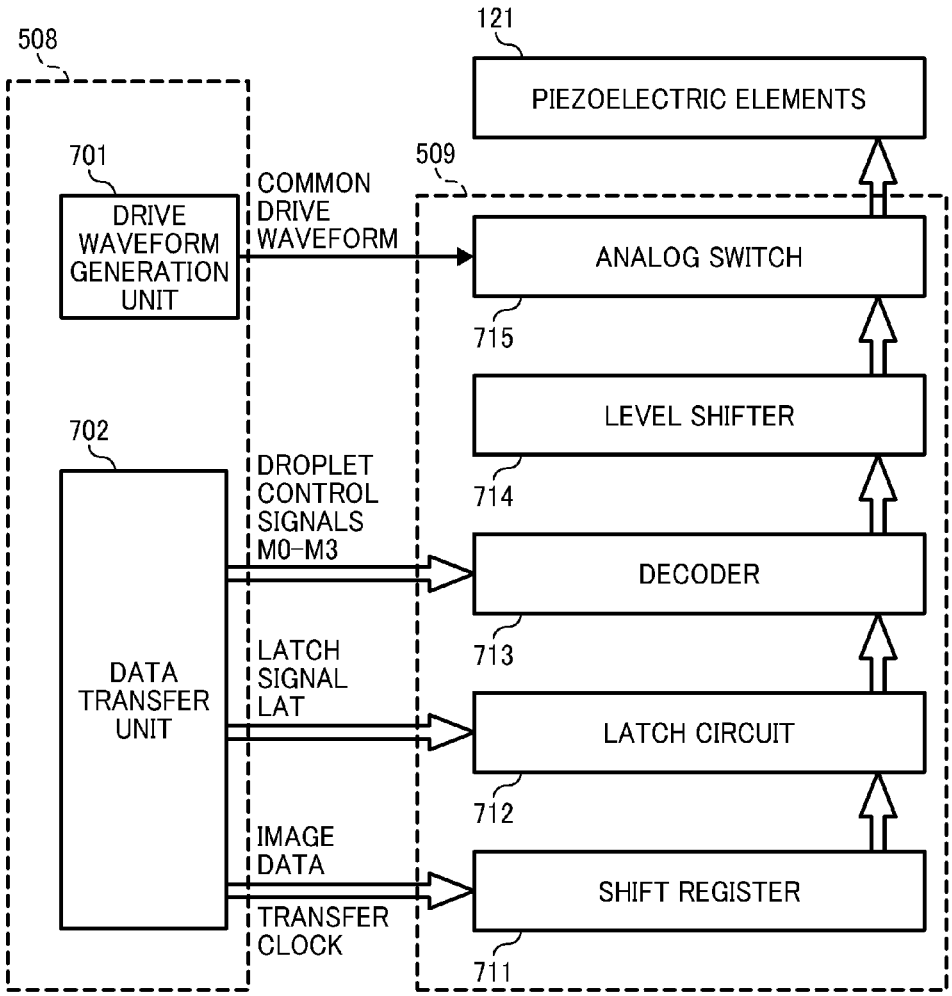
FIG. 4 is a block diagram illustrating an example of a print control unit of the control unit illustrated in FIG. 3 and a head driver.

An example of the print control unit 508 and the head driver 509 will now be described with reference to FIG. 4. As described above, the print control unit 508 includes the drive waveform generation unit 701 and the data transfer unit 702. The drive waveform generation unit 701 generates and outputs, in a print cycle of the image formation, a common drive waveform formed by a drive signal including a plurality of drive pulses, and generates and outputs, in a preliminary ejection cycle of the preliminary ejecting operation, a common drive waveform formed by a drive signal including a plurality of drive pulses. The data transfer unit 702 outputs two bits of image data (i.e., gradation signal with 0 and 1 values) according to a print image, a clock signal, a latch signal LAT, and droplet control signals M0 to M3. The droplet control signals M0 to M3 are 2-bit signals which instruct, for each droplet, the opening and closing of a later-described analog switch 715 serving as a switch device of the head driver 509. The droplet control signals M0 to M3 shift to the H level corresponding to the ON state with the waveform to be selected in accordance with the print cycle of the drive waveform, and shift to the L level corresponding to the OFF state when the drive waveform is not selected.

The head driver 509 includes a shift register 711, a latch circuit 712, a decoder 713, a level shifter 714, and an analog switch 715. The shift register 711 receives the transfer clock (i.e., shift clock) and the serial image data corresponding to two bits per channel (i.e., per nozzle) of gradation data input from the data transfer unit 702. The latch circuit 712 latches respective registration values of the shift register 711 in accordance with the latch signal transmitted from the data transfer unit 702. The decoder 713 decodes the gradation data and the droplet control signals M0 to M3, and outputs the decoding results. The level shifter 714 level-converts a logic level voltage signal of the decoder 713 to a level allowing the operation of the analog switch 715. The analog switch 715 is turned on and off, i.e., opened and closed in accordance with the output of the decoder 713 provided via the level shifter 714.

The analog switch 715 is connected to the individual electrodes 153 of the piezoelectric elements 121, and receives an input of the drive waveform from the drive waveform generation unit 701. Therefore, when the analog switch 715 is turned on in accordance with the results of decoding by the decoder 713 of the serially transferred image data (i.e., gradation data) and the droplet control signals M0 to M3, the necessary drive signal forming the drive waveform is transmitted, i.e., selected, and applied to the piezoelectric elements 121.

Figure 5:
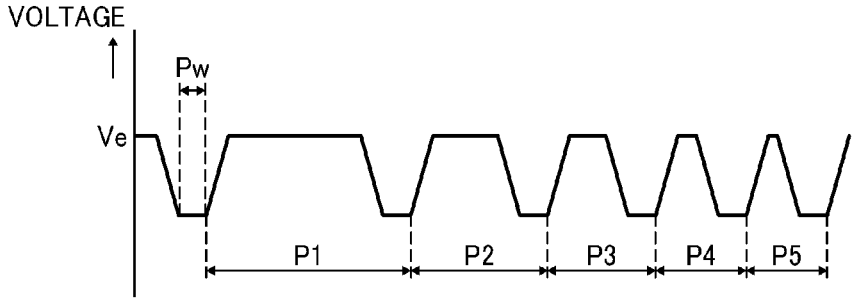
FIG. 5 is a diagram illustrating preliminary ejection drive pulses according to a first embodiment of the present invention.

Preliminary ejection drive pulses according to a first embodiment of the present invention will now be described with reference to FIG. 5. The preliminary ejection described herein is performed, prior to the operation of ejecting the ink droplets from the liquid ejection head 234 onto a recording medium or during the printing, to normalize the ejection state of the nozzles 104. Therefore, the drive waveform generation unit 701 generates and outputs, in a drive cycle, a drive waveform corresponding to a preliminary ejection drive signal including a plurality of successive drive pulses each including a waveform element that falls from a reference potential Ve and a waveform element that rises after a hold state in which there is no change in potential after the fall. In the present embodiment, the number of the plurality of drive pulses is six, for example.

Description will now be given of the waveform element in which a drive pulse potential V falls from the reference potential Ve. This waveform element corresponds to a drawing waveform element which causes the laminated piezoelectric elements 121 to contract and thereby expands the volume in the liquid pressurizing chambers 106. Meanwhile, the waveform element in which the drive pulse potential V rises after the fall corresponds to a raising waveform element which causes the laminated piezoelectric elements 121 to expand and thereby contracts the liquid pressurizing chambers 106. Further, the hold state in which there is no change in the drive pulse potential V after the fall is indicated by a reference sign Pw in FIG. 5, and is set to a first peak value of pressure resonance in the liquid pressurizing chambers 106. Thereby, the ejection efficiency per drive pulse is substantially maximized Accordingly, it is possible to reduce the voltage corresponding to the pulse height value of the drive waveform.

Further, each of reference signs P1 to P5 indicates the time period from the start point of the raising waveform element of a drive pulse to the start point of the raising waveform element of the next drive pulse (hereinafter referred to as the drive pulse interval). Herein, the time period of each of the drive pulse intervals P1 to P5 corresponds to an integral multiple of a natural vibration period Tc of the liquid pressurizing chambers 106. The natural vibration period Tc represents a characteristic value of the liquid pressurizing chambers 106. The application of the raising waveform element takes place at a time corresponding to a multiple of the natural vibration period Tc. Therefore, a stable period is employed in driving the liquid ejection head 234. Further, the first drive pulse interval P1 is the longest among the five drive pulse intervals P1 to P5; the later the drive pulse interval, the shorter the drive pulse interval.

For example, if the length of the drive pulse interval P1 is set to approximately five times the length of the natural vibration period Tc, the drive pulse interval P2 is approximately four times the length of the natural vibration period Tc, and the drive pulse interval P3 is approximately three times the length of the natural vibration period Tc. Further, the drive pulse interval P4 is approximately two times the length of the natural vibration period Tc, and the drive pulse interval P5 is approximately equal to the natural vibration period Tc. The drive pulse interval, however, is not necessarily required to be reduced by the natural vibration period Tc. For example, the drive pulse intervals may be sequentially set to approximately five times, approximately three times, and approximately equal to the natural vibration period Tc. With the application of the above-described preliminary ejection drive signal, the pressure in the liquid pressurizing chambers 106 is gradually increased. Accordingly, the high-viscosity ink is discharged without an excessive load placed on the meniscus. Particularly in a relatively long drive pulse interval corresponding to a few times the length of the natural vibration period Tc, as in the drive pulse interval P1, it is highly possible that the droplets of the high-viscosity ink fail to be ejected, depending on the level of the voltage. Even if the droplets of the high-viscosity ink fail to be ejected by an early-stage drive pulse, however, the driving by the drive pulse is considered to function similarly to fine driving, and favorably affects the discharge of the high-viscosity ink. Further, in accordance with the application of the subsequent drive pulses, the pressure in the liquid pressurizing chambers 106 is increased, and thus it gradually becomes easier to eject the droplets of the high-viscosity ink. The present control method, therefore, substantially reduces the load on the meniscus.

If a drive pulse for rapidly increasing the pressure in the liquid pressurizing chambers 106 is applied from the beginning, the purpose of discharging the high-viscosity ink is attained, but the load on the meniscus is increased. Further, it is conceivable that, if relatively high energy is applied by the drive pulse, the droplets of the high-viscosity ink, which are supposed to reach a later-described preliminary ejection receiver 284 illustrated in FIG. 10, may insufficiently fly and adhere to the nozzle surface of the liquid ejection head 234. Such a situation may result in a trouble, such as liquid stagnation in the nearby nozzles 104. The preliminary ejecting operation is desired to be performed to restore the state of dried meniscus in the nozzles 104. It is therefore important to reliably perform the preliminary ejecting operation. The preliminary ejecting operation according to the first embodiment reduces the load on the meniscus, and is performed with relatively high reliability.

Figure 6:
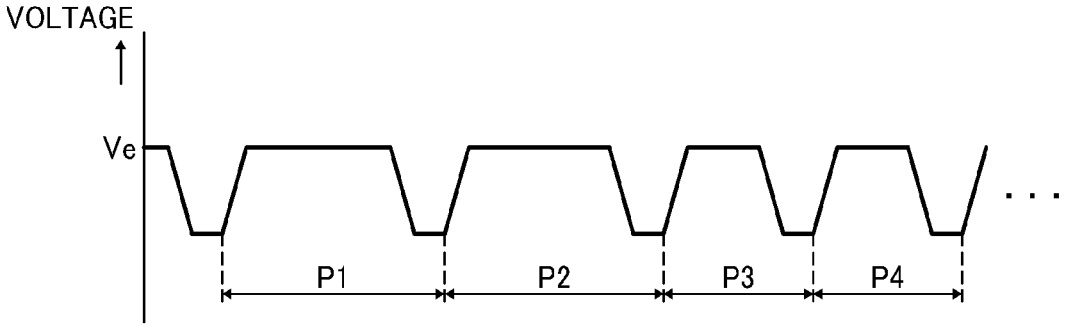
FIG. 6 is a diagram illustrating preliminary ejection drive pulses according to a second embodiment of the present invention.

Preliminary ejection drive pulses according to a second embodiment of the present invention will now be described with reference to FIG. 6. Also in the present embodiment, the preliminary ejection of the ink droplets is performed, prior to the operation of ejecting the ink droplets from the liquid ejection head 234 onto a recording medium or during the printing, to normalize the ejection state of the nozzles 104. In FIG. 5, the first drive pulse interval P1 is the longest among the preliminary ejection drive pulses, and the later the drive pulse interval is, the shorter the drive pulse interval is. Meanwhile, in the preliminary ejection drive pulses illustrated in FIG. 6, the drive pulse interval P1 and the subsequent drive pulse interval P2 have the same length, and the further subsequent drive pulse intervals P3 and P4 have the same length shorter than the length of the drive pulse intervals P1 and P2. A preliminary ejection drive signal of the present embodiment thus includes two pairs of drive pulse intervals having the same length. Each of the drive pulse intervals corresponds to an integral multiple of the natural vibration period Tc of the liquid pressurizing chambers 106. With this sequence of two drive pulse intervals having the same length, the pressure in the liquid pressurizing chambers 106 is increased more gradually than in the first embodiment, and the load on the meniscus is further reduced. Consequently, the high-viscosity ink is more reliably discharged.

Figure 7:
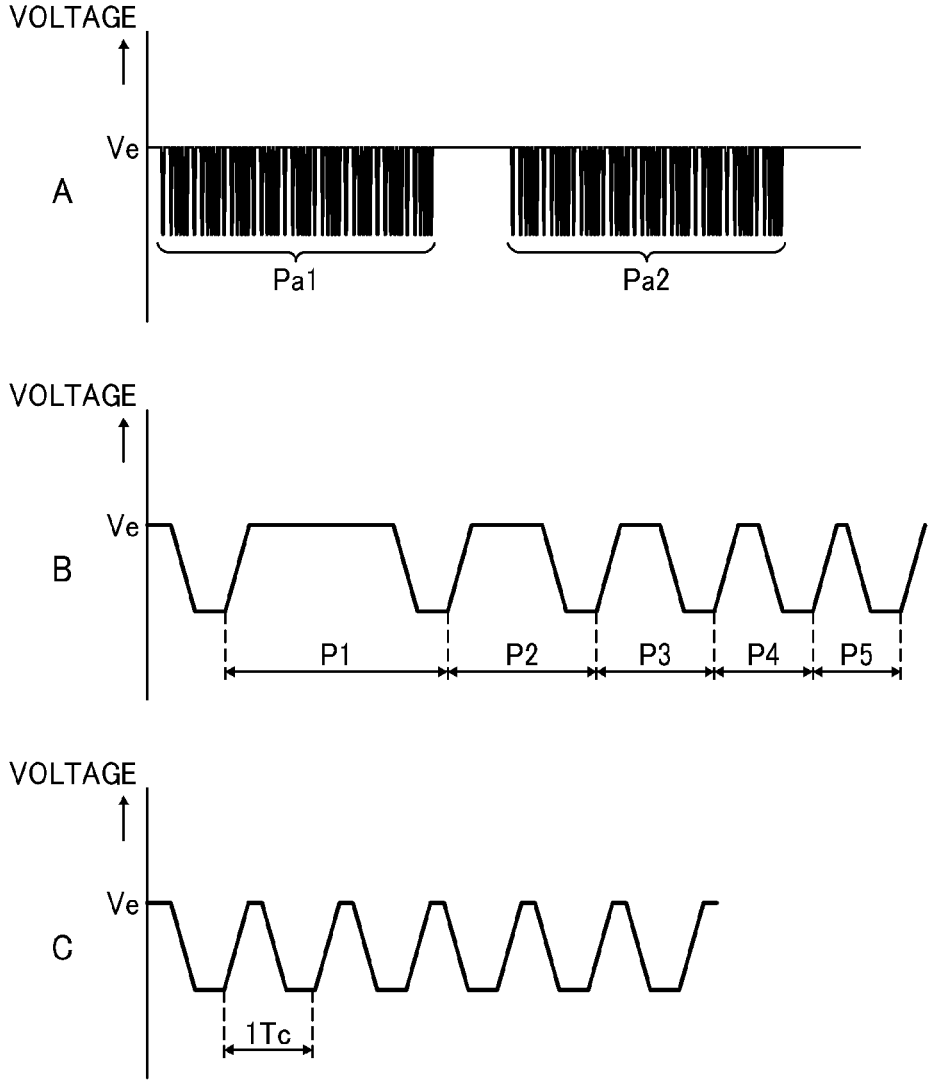
FIGS. 7A to 7C are diagrams illustrating preliminary ejection drive pulses according to a third embodiment of the present invention.

Preliminary ejection drive pulses according to a third embodiment of the present invention will now be described with reference to FIGS. 7A to 7C. In the present embodiment, prior to the operation of ejecting the ink droplets from the liquid ejection head 234 onto a recording medium or during the printing, the preliminary ejecting operation is intermittently performed with an arbitrary number of ejection droplets to normalize the ejection state of the nozzles 104. That is, while the first and second embodiments continuously apply the preliminary ejection drive pulses, as illustrated in FIGS. 5 and 6, the third embodiment is different from the foregoing embodiments in intermittently driving the preliminary ejection, as illustrated in FIG. 7A. Although FIG. 7A illustrates two high-viscosity ink droplet ejection groups Pa1 and Pa2, the driving may be performed with the ejections divided into more than two high-viscosity ink droplet ejection groups. The preliminary ejection drive pulses forming the high-viscosity ink droplet ejection group Pa1 are similar to the preliminary ejection drive pulses of FIG. 5, as illustrated in FIG. 7B. The time period of each of the drive pulse intervals P1 to P5 corresponds to an integral multiple of the natural vibration period Tc of the liquid pressurizing chambers 106. The drive pulse interval P1 is the longest among the drive pulse intervals P1 to P5, and the later the drive pulse interval is, the shorter the drive pulse interval is. Further, in the preliminary ejection drive pulses forming the high-viscosity ink droplet ejection group Pa2, each of the drive pulse intervals is set to the length represented as 1Tc, i.e., the length of the natural vibration period Tc of the liquid pressurizing chambers 106, as illustrated in FIG. 7C.

Description will now be given of an advantage of the third embodiment which intermittently drives the preliminary ejection. In the first high-viscosity ink droplet ejection group Pa1, the drive pulses are the same as the drive pulses illustrated in FIG. 5, but the number of high-viscosity ink droplets is set to be less than the number of high-viscosity ink droplets of the first embodiment. In the high-viscosity ink droplet ejection group Pa1, all of the high-viscosity ink is not discharged, and it suffices if a certain amount of the ink is discharged. In the subsequent high-viscosity ink droplet ejection group Pa2, each of the drive pulse intervals is set to the length of 1Tc. Thus, the ejection efficiency is substantially maximized, and the pressure in the liquid pressurizing chambers 106 is increased. In the high-viscosity ink droplet ejection group Pa2, therefore, the remaining high-viscosity ink is discharged at one time. The drive pulses of the high-viscosity ink droplet ejection group Pa2 are relatively effective. Accordingly, it is possible to reduce the number of ejection droplets of the high-viscosity ink. In the present embodiment, therefore, it is possible to set the total number of high-viscosity ink droplets ejected in the preliminary ejection to be less than in the first and second embodiments.

Figure 8:
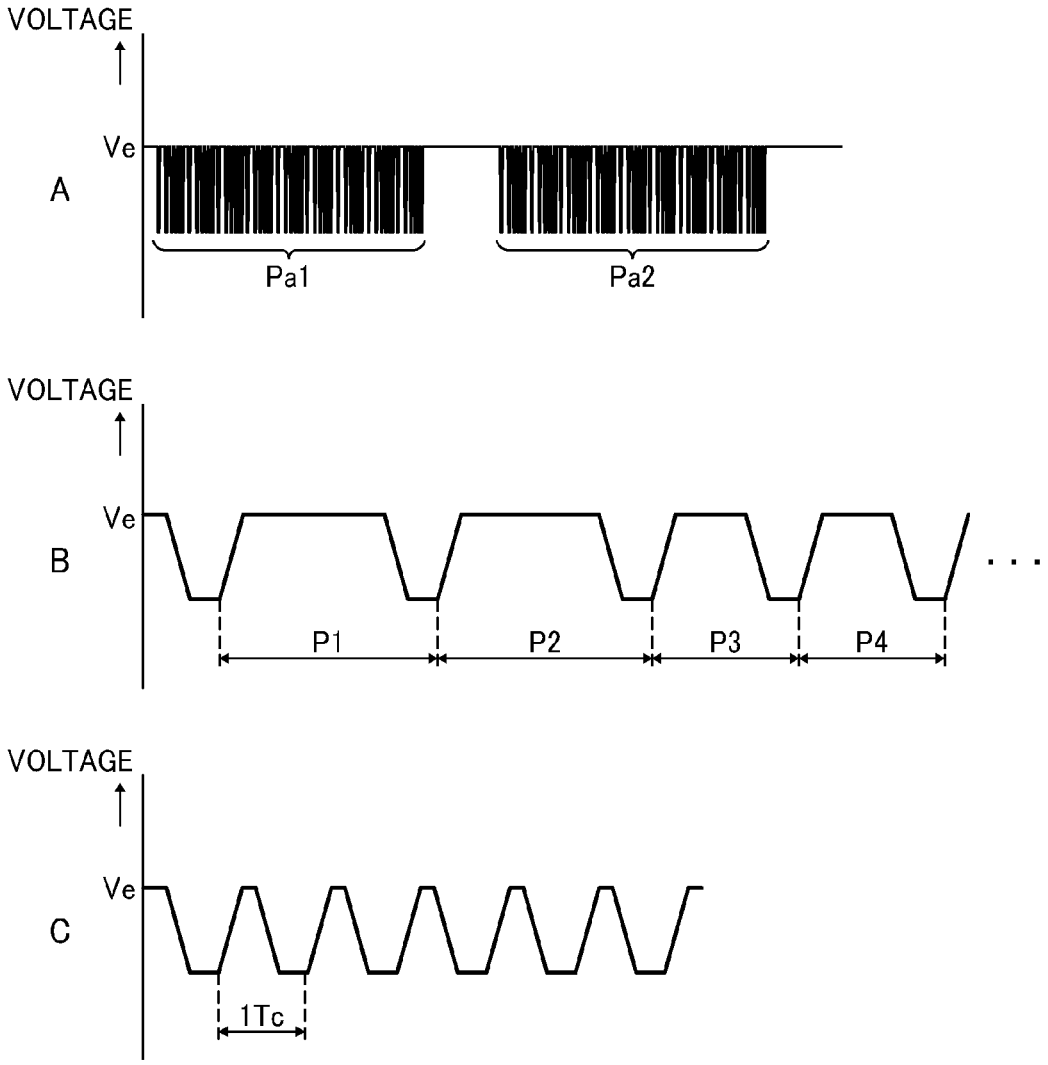
FIGS. 8A to 8C are diagrams illustrating preliminary ejection drive pulses according to a fourth embodiment of the present invention.

Preliminary ejection drive pulses according to a fourth embodiment of the present invention will now be described with reference to FIGS. 8A to 8C. As illustrated in FIG. 8B, the present embodiment is different from the third embodiment in that the preliminary ejection drive pulses forming the first high-viscosity ink droplet ejection group Pa1 are similar to the preliminary ejection drive pulses illustrated in FIG. 6. The present embodiment is the same as the third embodiment in the other aspects. Specifically, the time period of each of the drive pulse intervals P1 to P5 corresponds to an integral multiple of the natural vibration period Tc of the liquid pressurizing chambers 106. Further, the drive pulse interval P1 and the subsequent drive pulse interval P2 have the same length, and the further subsequent drive pulse intervals P3 and P4 have the same length shorter than the length of the drive pulse intervals P1 and P2. A preliminary ejection drive signal of the present embodiment thus includes two pairs of drive pulse intervals having the same length. Further, in the preliminary ejection drive pulses forming the high-viscosity ink droplet ejection group Pa2, each of the drive pulse intervals is set to the same length of 1Tc, i.e., the length of the natural vibration period Tc of the liquid pressurizing chambers 106, as illustrated in FIG. 8C.

According to the present embodiment, the load on the meniscus is relatively small in the first high-viscosity ink droplet ejection group Pa1. Therefore, a trouble such as liquid stagnation in the nozzles 104 is prevented, and the high-viscosity ink is discharged with relative reliability.

In the above-described embodiments, if the drive pulse width of each of the drive pulses forming the preliminary ejection drive waveform is set to the first peak value of pressure resonance in the liquid pressurizing chambers 106, the ejection efficiency per drive pulse is substantially maximized, and thus it is possible to reduce the drive voltage. If the drive pulse width of each of the drive pulses forming the preliminary ejection drive waveform is set to the first peak value, therefore, it is possible to substantially minimize the drive voltage.

Figure 9:
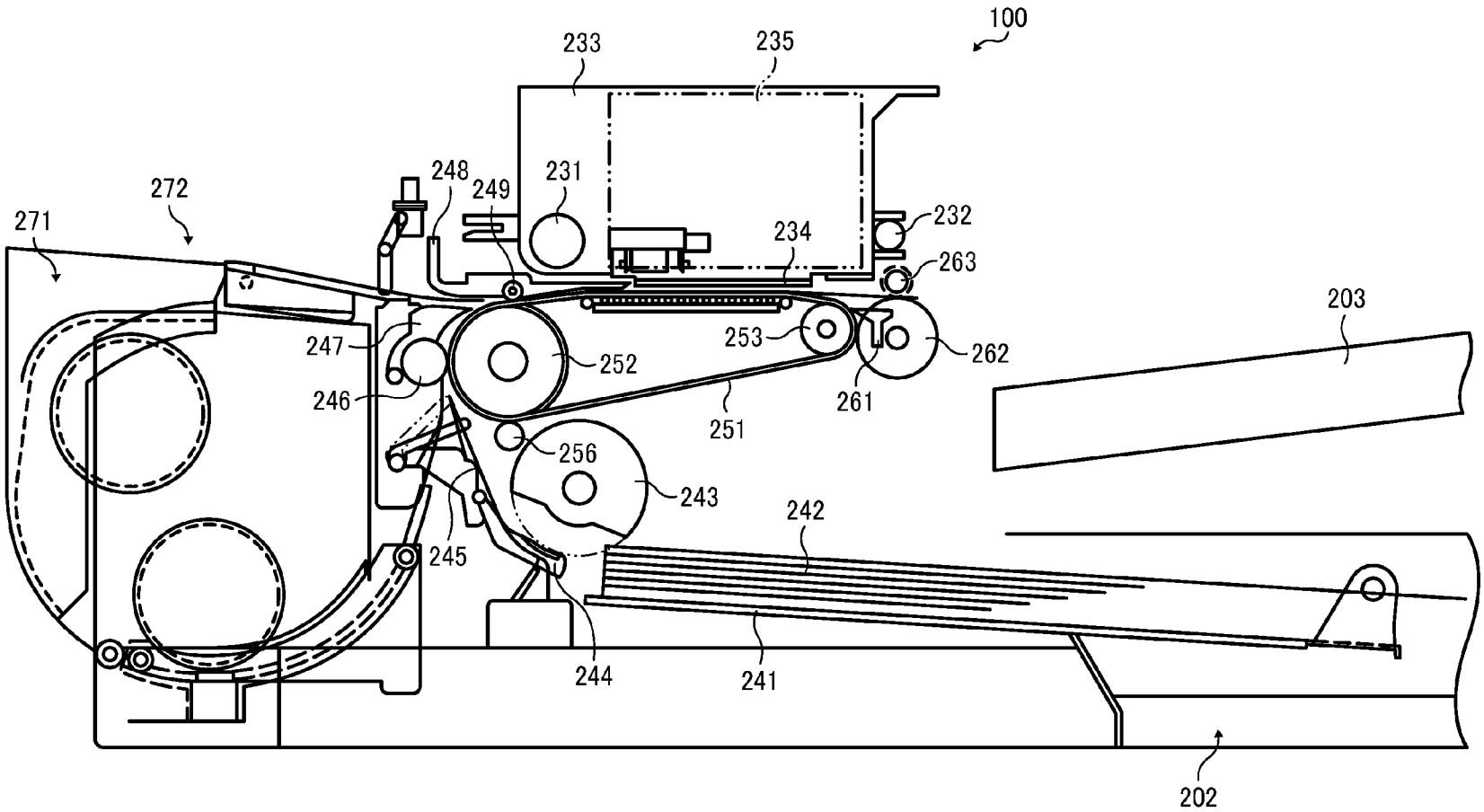
FIG. 9 is a side view illustrating an example of a mechanical portion of the liquid ejection device according to the embodiment of the present invention.
Figure 10:
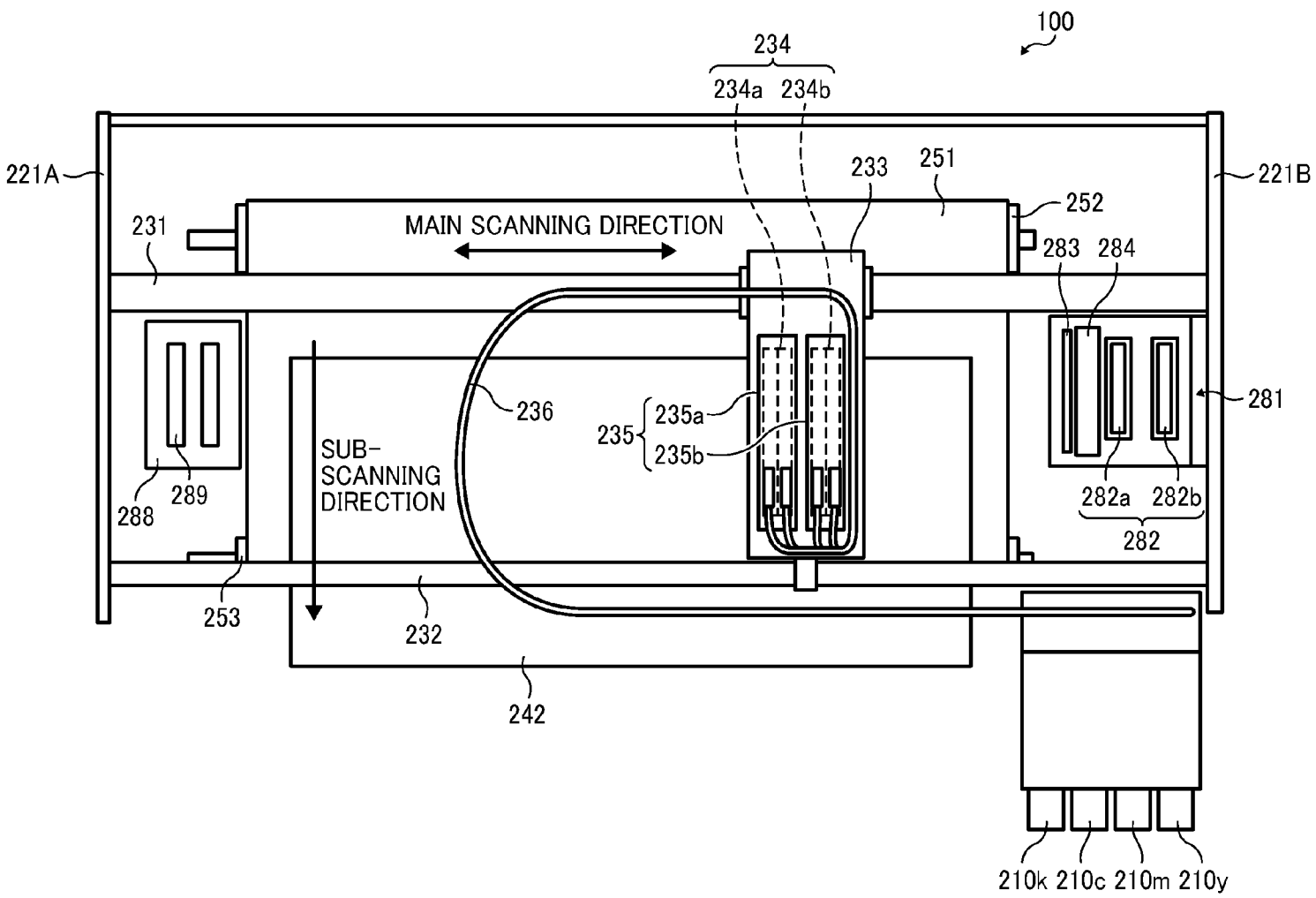
FIG. 10 is a plan view illustrating major components of the mechanical portion of the liquid ejection device illustrated in FIG. 9.

The liquid ejection device 100 according to the embodiment of the present invention will now be described with reference to FIGS. 9 and 10. FIG. 9 is a side view illustrating an example of a mechanical portion of the present liquid ejection device 100. FIG. 10 is a plan view illustrating major components of the mechanical portion.

The present liquid ejection device 100 is a serial-type liquid ejection device. In FIG. 10, a main guide rod 231 and a sub-guide rod 232, which are guide members extending laterally and supported by a left side plate 221A and a right side plate 221B, hold a carriage 233 to be movable in the carriage main scanning direction indicated by a double-headed arrow in FIG. 10 (hereinafter simply referred to as the main scanning direction). The carriage 233 is driven by the main scanning motor 554 illustrated in FIG. 3 via a not-illustrated timing belt, and thereby performs scanning while moving in the main scanning direction.

Liquid ejection heads 234*a* and 234*b* (hereinafter referred to as the liquid ejection heads 234 where distinction therebetween is unnecessary) are installed in the carriage 233 for ejecting ink droplets of yellow, cyan, magenta, and black (hereinafter referred to as Y, C, M, and K, respectively) colors. Each of the liquid ejection heads 234 includes two nozzle rows each including a plurality of nozzles 104 arranged in a sub-scanning direction perpendicular to the main scanning direction and corresponding to the belt feeding direction. The ink droplet ejecting direction of the liquid ejection heads 234 is set downward. One of the nozzle rows of the liquid ejection head 234*a* ejects a K ink liquid, and the other nozzle row of the liquid ejection head 234*a* ejects a C ink liquid. Further, one of the nozzle rows of the liquid ejection head 234*b* ejects an M ink liquid, and the other nozzle row of the liquid ejection head 234*b* ejects a Y ink liquid.

The carriage 233 further mounts head tanks (alternatively referred to as sub-tanks) 235*a* and 235*b* (hereinafter referred to as the head tanks 235 where distinction therebetween is unnecessary) for supplying inks of the respective colors to the nozzle rows of the liquid ejection heads 234. The head tanks 235 are supplied with the inks of the respective colors from ink cartridges 210*k*, 210*c*, 210*m*, and 210*y* for the respective colors via supply tubes 236 for the respective colors.

In FIG. 9, sheets 242 are stacked on a sheet loading unit 241 formed by a bearing plate and disposed in a sheet feed tray 202. The liquid ejection device 100 includes, as a sheet feeding unit for feeding the sheets 242, a semicircular sheet feed roller 243 and a separation pad 244. The sheet feed roller 243 separates and feeds one of the sheets 242 from the sheet loading unit 241. The separation pad 244 made of a material having a relatively high friction coefficient faces the sheet feed roller 243 and is biased toward the sheet feed roller 243.

To send the sheet 242 fed from the sheet feeding unit to a position under the liquid ejection heads 234, the liquid ejection device 100 includes a guide member 245, a counter roller 246, and a feed guide member 247 for guiding the sheet 242. The liquid ejection device 100 further includes a holding member 248 including a leading end pressurizing roller 249, and a feed belt 251 serving as a feeding device for electrostatically attracting the fed sheet 242 and feeding the sheet 242 to a position facing the liquid ejection heads 234.

The feed belt 251 is an endless belt stretched between a feed roller 252 and a tension roller 253, and is configured to rotate in the belt feeding direction corresponding to the sub-scanning direction. The liquid ejection device 100 further includes a charge roller 256 serving as a charging device for charging the outer circumferential surface of the feed belt 251. The charge roller 256 is disposed to be in contact with the outer circumferential surface of the feed belt 251 and rotate in accordance with the rotation of the feed belt 251. As the feed roller 252 is driven to rotate at a predetermined time by the sub-canning motor 555 illustrated in FIG. 3, the feed belt 251 rotates in the belt feeding direction.

The liquid ejection device 100 further includes, as a sheet discharging unit for discharging the sheet 242 subjected to the recording by the liquid ejection heads 234, a separation plate 261 for separating the sheet 242 from the feed belt 251, sheet discharge rollers 262 and 263, and a sheet discharge tray 203 provided below the sheet discharge roller 262. Further, a duplex unit 271 is attachably and detachably installed in a rear portion of the body of the liquid ejection device 100. The duplex unit 271 receives the sheet 242 returned by reverse rotation of the feed belt 251, reverses the sheet 242, and feeds the sheet 242 again into the space between the counter roller 246 and the feed belt 251.

The upper surface of the duplex unit 271 forms a manual feed tray 272. Further, in a non-print area on one side in the main scanning direction of the carriage 233, a maintaining and restoring mechanism 281 illustrated in FIG. 10 is provided which maintains and restores the state of the nozzles 104 of the liquid ejection heads 234. As illustrated in FIG. 10, the maintaining and restoring mechanism 281 includes cap members (hereinafter referred to as caps) 282*a* and 282*b*, a wiper blade 283, and a preliminary ejection receiver 284. The caps 282*a* and 282*b* (hereinafter referred to as the caps 282 where distinction therebetween is unnecessary) cap the respective nozzle surfaces of the liquid ejection heads 234. The wiper blade 283 is a blade member for wiping the nozzle surfaces. The preliminary ejection receiver 284 receives liquid droplets in the preliminary ejection of ejecting liquid droplets not contributing to the recording to discharge a viscosity-increased recording liquid.

Further, in a non-print area on the other side in the main scanning direction of the carriage 233, an ink collecting unit 288 serving as a preliminary ejection receiver is disposed which is a liquid collecting container for receiving liquid droplets in the preliminary ejection of ejecting liquid droplets not contributing to the recording to discharge a viscosity-increased recording liquid during, for example, the recording. The ink collecting unit 288 includes openings 289 extending along the nozzle rows of the liquid ejection heads 234.

As illustrated in FIG. 9, in the thus configured liquid ejection device 100 according to the present embodiment, one of the sheets 242 is separated and fed from the sheet feed tray 202, guided substantially straight upward by the guide member 245, nipped and fed by the feed belt 251 and the counter roller 246, and changed in the feeding direction by approximately ninety degrees, with the leading end of the sheet 242 guided by the feed guide member 247 and pressed against the feed belt 251 by the leading end pressurizing roller 249. In this process, the charge roller 256 is applied with an alternating voltage such that a positive output and a negative output alternate. Thereby, the feed belt 251 is charged with an alternating charging voltage pattern, i.e., alternately charged with positive and negative polarities each in a band-like pattern with a predetermined width in the sub-scanning direction corresponding to the rotation direction of the feed belt 251.

When the sheet 242 is fed onto the feed belt 251 alternately charged with the positive and negative polarities, the sheet 242 is attracted to the feed belt 251 and fed in the sub-scanning direction in accordance with the rotation of the feed belt 251. Then, the liquid ejection heads 234 are driven in accordance with an image signal while the carriage 233 is moved. Thereby, one line of data is recorded with ink droplets ejected onto the sheet 242 at rest. The sheet 242 is then fed by a predetermined distance, and thereafter the next line of data is recorded. Upon receipt of a recording end signal or a signal indicating that the rear end of the sheet 242 has reached a recording area, the recording operation is completed, and the sheet 242 is discharged onto the sheet discharge tray 203.

As described above, the present liquid ejection device 100 includes the above-described liquid ejection heads 234, and thus forms a relatively stable image in an energy-efficient manner. Particularly, the liquid ejection device 100 including the liquid ejection heads 234 has a substantial effect in ejecting the high-viscosity ink, and thus is capable of reducing the drive voltage for the preliminary ejection, the time taken for the preliminary ejection, and the number of ink droplets to be ejected.

In the above-described embodiments, description has been given of the example in which the present invention is applied to the liquid ejection device 100 configured as a printer. However, the configuration is not limited thereto. For example, the present invention is applicable to a liquid ejection device configured as a multifunction machine combining a printer, a facsimile machine, and a copier. The present invention is also applicable to an image forming apparatus using, for example, a recording liquid other than the ink, a resist material, or a deoxyribonucleic acid (DNA) sample.

As described above in the foregoing embodiments of the present invention, according to an embodiment, a plurality of drive pulses form the preliminary ejection drive waveform for the preliminary ejection performed, prior to the operation of ejecting the liquid droplets from the liquid ejection heads 234 onto a recording medium or during the printing, to normalize the ejection state of the nozzles 104. When the natural vibration period of the liquid pressurizing chambers 106 is represented as Tc, each of the drive pulse intervals corresponds to an integral multiple of the natural vibration period Tc. Further, the length of the first drive pulse interval between the first and second drive pulses corresponds to the largest integral multiple. After the first drive pulse interval, the length of the drive pulse interval is gradually reduced with time. With this configuration of the drive pulses, the pressure in the liquid pressuring chambers 106 is gradually increased every time a drive pulse is applied. Accordingly, the high-viscosity ink is relatively reliably discharged without an excessive load placed on the meniscus.

Further, according to another embodiment, the first and second drive pulse intervals of the preliminary ejection drive waveform have the same length corresponding to an integral multiple of the natural vibration period Tc, and the subsequent third and fourth drive pulse intervals have the same length less than the integral multiple corresponding to the first and second drive pulse intervals by, for example, the value 1Tc. With this configuration of the drive pulses including two pairs of drive pulse intervals having the same length, the pressure in the liquid pressurizing chambers 106 is gradually increased. Accordingly, the load on the meniscus is further reduced, and the high-viscosity ink is relatively reliably discharged.

Further, according to another embodiment, when the preliminary ejecting operation is intermittently performed with an arbitrary number of ejection droplets, prior to the operation of ejecting the liquid droplets from the liquid ejection heads 234 onto a recording medium or during the printing, to normalize the ejection state of the nozzles 104, a plurality of drive pulses form the preliminary ejection drive waveform forming the first high-viscosity ink droplet ejection group Pa1. When the natural vibration period of the liquid pressurizing chambers 106 is represented as Tc, the length of the first drive pulse interval between the first and subsequent drive pulses corresponds to the largest integral multiple of the natural vibration period Tc. After the first drive pulse interval, the length of the drive pulse interval is gradually reduced with time. In this configuration of the drive pulses, the length of each of the drive pulse intervals is set to the value 1Tc in the second high-viscosity ink droplet ejection group Pa2 and any subsequent high-viscosity ink droplet ejection group. Accordingly, a certain amount of high-viscosity ink is discharged in the first high-viscosity ink droplet ejection group Pa1, and the meniscus is normalized at one time in the second high-viscosity ink droplet ejection group Pa2 and any subsequent high-viscosity ink droplet ejection group.

Further, according to another embodiment, in the preliminary ejection drive waveform forming the first high-viscosity ink droplet ejection group Pa1, the first and second drive pulse intervals have the same length corresponding to an integral multiple of the natural vibration period Tc, and the subsequent third and fourth drive pulse intervals have the same length less than the integral multiple corresponding to the first and second drive pulse intervals by, for example, the value 1Tc. With this configuration of the drive pulses including two pairs of drive pulse intervals having the same length, the pressure in the liquid pressurizing chambers 106 is gradually increased in the first high-viscosity ink droplet ejection group Pa1, and the load on the meniscus is reduced. Further, the length of each of the drive pulse intervals is set to the value 1Tc in the second high-viscosity ink droplet ejection group Pa2 and any subsequent high-viscosity ink droplet ejection group. Accordingly, the meniscus is normalized at one time.

Further, according to another embodiment, the drive pulse width of each of the drive pulses forming the preliminary ejection drive waveform is set to the first peak value of pressure resonance in the liquid pressurizing chambers 106. Accordingly, the ejection efficiency per drive pulse is substantially maximized, and thus it is possible to reduce the drive voltage.

The above-described embodiments are illustrative and do not limit the present invention. Thus, numerous additional modifications and variations are possible in light of the above teachings. For example, elements or features of different illustrative and embodiments herein may be combined with or substituted for each other within the scope of this disclosure and the appended claims. Further, features of components of the embodiments, such as number, position, and shape, are not limited to those of the disclosed embodiments and thus may be set as preferred. It is therefore to be understood that, within the scope of the appended claims, the disclosure of the present invention may be practiced otherwise than as specifically described herein.

What is claimed is:

1. A method of controlling a liquid ejection head including a liquid pressurizing chamber, nozzles communicating with the liquid pressurizing chamber, and a pressure generating device that generates pressure in the liquid pressurizing chamber based on a drive waveform, the method comprising:

generating a preliminary ejection drive waveform with a predetermined number of successive drive pulses aligned in descending order of length of drive pulse intervals of the drive pulses, with each of the drive pulse intervals set to an integral multiple of a natural vibration period of the liquid pressurizing chamber; and applying the generated preliminary ejection drive waveform to the pressure generating device to cause the liquid ejection head to perform a preliminary ejecting operation.

2. The method of controlling a liquid ejection head according to claim 1, wherein the generating generates the preliminary ejection drive waveform, with the length of the drive pulse intervals reduced at every drive pulse interval.

3. The method of controlling a liquid ejection head according to claim 1, wherein the generating generates the preliminary ejection drive waveform, with the length of the drive pulse intervals reduced at every two adjacent drive pulse intervals having the same length.

4. The method of controlling a liquid ejection head according to claim 1, wherein a drive pulse width of each of the drive pulses forming the preliminary ejection drive waveform is set to a first peak value of pressure resonance in the liquid pressurizing chamber.

5. A method of controlling a liquid ejection head including a liquid pressurizing chamber, nozzles communicating with the liquid pressurizing chamber, and a pressure generating device that generates pressure in the liquid pressurizing chamber based on a drive waveform, the method comprising:

generating a preliminary ejection drive waveform for a first high-viscosity ink droplet ejection group with a predetermined number of successive drive pulses aligned in descending order of length of drive pulse intervals of the drive pulses, with each of the drive pulse intervals set to an integral multiple of a natural vibration period of the liquid pressurizing chamber;

generating a preliminary ejection drive waveform for a high-viscosity ink droplet ejection group subsequent to the first high-viscosity ink droplet ejection group with drive pulses having the same drive pulse interval set to the natural vibration period of the liquid pressurizing chamber; and applying the generated preliminary ejection drive waveforms to the pressure generating device to cause the liquid ejection head to intermittently perform a preliminary ejecting operation with the high-viscosity ink droplet ejection groups, each with an arbitrary number of ejection droplets.

6. The method of controlling a liquid ejection head according to claim 5, wherein the generating the preliminary ejection drive waveform for the first high-viscosity ink ejection group generates the preliminary ejection drive waveform, with the length of the drive pulse intervals reduced every drive pulse interval.

7. The method of controlling a liquid ejection head according to claim 5, wherein the generating the preliminary ejection drive waveform for the first high-viscosity ink ejection group generates the preliminary ejection drive waveform, with the length of the drive pulse intervals reduced at every two adjacent drive pulse intervals having the same length.

8. The method of controlling a liquid ejection head according to claim 5, wherein a drive pulse width of each of the drive pulses forming the preliminary ejection drive waveforms is set to a first peak value of pressure resonance in the liquid pressurizing chamber.

9. A liquid ejection device comprising:

a liquid ejection head configured to include a liquid pressurizing chamber;

nozzles communicating with the liquid pressurizing chamber; and a pressure generating device that generates pressure in the liquid pressurizing chamber based on a drive waveform;

a waveform generating device configured to generate a preliminary ejection drive waveform with a predetermined number of successive drive pulses aligned in descending order of length of drive pulse intervals of the drive pulses, with each of the drive pulse intervals set to an integral multiple of a natural vibration period of the liquid pressurizing chamber; and a waveform applying device configured to apply the generated preliminary ejection drive waveform generated by the waveform generating device to the pressure generating device to cause the liquid ejection head to perform a preliminary ejecting operation.

* * * * *